United States Patent [19]

Derbyshire

[11] 4,279,946

[45] Jul. 21, 1981

[54] COATING COMPOSITIONS

[75] Inventor: Stewart Derbyshire, Birmingham, England

[73] Assignee: Foseco International Limited, Birmingham, England

[21] Appl. No.: 937,840

[22] Filed: Aug. 29, 1978

[30] Foreign Application Priority Data

Sep. 7, 1977 [GB] United Kingdom ..... 37385/77

[51] Int. Cl.[3] ..... B29C 1/04

[52] U.S. Cl. ..... 427/133; 427/134; 427/155; 427/224; 427/226

[58] Field of Search ..... 427/133–135, 427/224, 226; 106/38.22, 38.27, 38.3, 38.25, 38.9, 38.6, 38.24, 38.8

[56] References Cited

U.S. PATENT DOCUMENTS

| | | | |
|---|---|---|---|
| 686,189 | 11/1901 | Atha | 427/134 |
| 2,236,119 | 3/1941 | Craig et al. | 427/224 |
| 2,245,651 | 6/1941 | Craig et al. | 427/224 |
| 2,256,832 | 9/1941 | King | 427/134 |
| 2,618,032 | 11/1952 | Traenker | 427/133 |
| 2,848,819 | 8/1958 | Schoenfeld | 427/224 |
| 3,406,236 | 10/1968 | Kniege | 427/133 |
| 3,993,494 | 11/1976 | Nyman | 427/133 |
| 3,994,734 | 11/1976 | Cuthbert | 106/38.22 |
| 4,071,368 | 1/1978 | Jones | 106/38.22 |

FOREIGN PATENT DOCUMENTS

| | | |
|---|---|---|
| 738904 | 10/1955 | United Kingdom . |
| 949526 | 2/1964 | United Kingdom . |
| 975331 | 11/1964 | United Kingdom . |
| 1024219 | 3/1966 | United Kingdom . |
| 1532864 | 11/1978 | United Kingdom . |

*Primary Examiner*—Ronald H. Smith
*Assistant Examiner*—Janyce A. Bell
*Attorney, Agent, or Firm*—Cushman, Darby & Cushman

[57] ABSTRACT

Flammable foundry coatings are disclosed in which the carrier liquid is safer to handle than previously used types e.g. isopropanol, and which also burns off more satisfactorily. The carrier liquid is a mixture of an essentially aliphatic hydrocarbon liquid of flash point greater than 32° C., e.g. an aliphatic petroleum distillate, and a mono alkyl ether of a polyhydric alcohol, e.g. ethylene glycol monoethyl ether (oxitol).

10 Claims, No Drawings

COATING COMPOSITIONS

This invention relates to carrier liquids for coating compositions, and particularly to carrier liquids for coating compositions for use on foundry sand moulds and cores.

In this specification reference is made to "Flash Point". These references refer throughout to flash point determinations made by the Pensky-martens closed cup method as set out in BS 2839: 1969.

One of two types of coating composition is generally used for coating foundry sand moulds and cores viz a water-based composition or a so-called spirit-based composition. Spirit-based coating compositions usually contain isopropanol as a liquid carrier for the coating constituents, and the coating is dried by igniting and burning the isopropanol.

However, because of its low flash point of 10° C., isopropanol is classed as a highly flammable liquid and stringent regulations governing its use operate in many countries. For example in the U.K. the Petroleum (Consolidation) Act of 1928 lays down strict regulations covering the storage and use of such liquids. In addition isopropanol tends to burn violently and with a high flame so that when a coating composition is applied to a mould or core and ignited, flame tends to shoot rapidly over the surface of the mould or core from the point of ignition.

It is therefore desirable to find an alternative liquid carrier which although flammable does not suffer from all the disadvantages of isopropanol.

Such a liquid carrier should preferably have a flash point in excess of 32° C., be non-toxic, should be readily ignitable when a coating composition containing the liquid has been applied to a core or mould, and should burn without violence.

While certain hydrocarbon carriers such as highly refined aliphatic hydrocarbons would fulfill these requirements such carriers suffer from other disadvantages in that when they are burned there is insufficient oxygen available in the surrounding air for the carrier to be burned completely. These carriers therefore produce a very sooty flame thus polluting the surrounding atmosphere and making coatings based on them unpleasant to apply. In addition hydrocarbon carriers produce a very hot flame when they burn, and the heat generated can cause cracking of the core or mould to which the coating composition containing the hydrocarbon carrier has been applied.

It has now been found that such hyrdrocarbons may be improved as carriers by the addition of an aliphatic ether which will supply oxygen and ensure essentially complete combustion of the hydrocarbons when they are burned.

According to the present invention there is provided a carrier liquid for a coating composition which comprises:

(i) an essentially aliphatic hydrocarbon having a Flash Point in excess of 32° C., and (ii) a mono alkyl ether of a polyhydric alcohol.

According to a further feature of the invention there is provided a coating composition which comprises particulate refractory material and a carrier liquid for the particulate refractory material comprising an essentially aliphatic hydrocarbon having a Flash Point in excess of 32° C., and a mono alkyl ether of a polyhydric alcohol.

Suitable aliphatic hydrocarbons are available commercially as mixtures of highly refined, low toxicity hydrocarbons having extremely low aromatic contents.

Example of suitable ethers are ethylene glycol monoethyl ether, diethylene glycol monoethyl ether, triethylene glycol monoethyl ether, ethylene glycol monomethyl ether and ethylene glycol monobutyl ether.

The carrier liquids according to the invention may be formulated to have a Flash Point sufficiently high to avoid difficulties in their storage and use arising from statutory controls such as the Petroleum (Consolidation) Act of 1928. However, such carrier liquids having a Flash Point too low to enable their use without careful precautions still show other advantages over isopropanol in that when used in a foundry coating composition they burn less violently and with a lower flame height than isopropanol.

Carrier liquids according to the invention usually contain 30 to 70% by weight of essentially aliphatic hydrocarbon and 30 to 70% by weight of ether.

The coating composition of the invention may contain any particulate refractory material known for use in foundry coating compositions. Examples of suitable particulate refractory fillers include zircon, alumina, chromite, silica, talc, olivine and carbonaceous materials such as graphite.

The coating composition may contain a binder for binding the particles of refractory material together after the coating composition has been applied to a mould or core and dried by burning the liquid carrier. Suitable binders include colophony resin, Southern Pinewood resins, alkyd resins and phenol-formaldehyde resins.

The coating composition may also contain a suspension agent to assist in maintaining the particles of refractory material in suspension in the liquid carrier. Examples of suitable suspension agents are hydrogenated castor oil and quaternary alkyl ammonium montmorillonite gels.

The coating compositions of the invention may be applied to foundry moulds and cores by any of the commonly used methods such as brushing or spraying. When the compositions are applied by spraying the spraying operation should be done in a well ventilated area since aliphatic ethers are to a certain extent toxic.

The form in the coating composition according to the invention is applied will depend for example on the method of application. Thus it will be appreciated that compositions for spraying will generally be less thick than those for application by brushing. Coating compositions applied will usually contain 14.5 to 74.5% by weight of carrier liquid, 25 to 85% by weight of particulate refractory material and 0.5 to 10% by weight of other components e.g. binder and suspension agent.

When the carrier liquid is burned after application of the coating composition combustion takes place quietly with low flame height and with little or no soot formation; no unpleasant odour is produced. In addition the temperature of the flame is lower than that of the flame from hydrocarbons alone.

The following examples will serve to illustrate the invention:

EXAMPLE 1

A carrier liquid was prepared having the following composition by weight:

Mixture of aliphatic hydrocarbons having a Flash Point of 42° C.: 75%

Ethylene glycol monoethyl ether: 25%

The average Flash Point of this carrier liquid was 30° C.

EXAMPLE 2

A carrier liquid was prepared having the following composition by weight:

Mixture of aliphatic hydrocarbons having a Flash Point of 60° C.: 50%

Ethylene glycol monobutyl ether: 50%

The Flash Point of this carrier liquid was 37° C.

EXAMPLE 3

A carrier liquid was prepared having the following composition by weight:

Mixture of aliphatic hydrocarbons having a Flash Point of 42° C.: 50%

Diethylene glycol monoethyl ether: 50%

The Flash Point of this carrier liquid was 32° C.

EXAMPLE 4

A coating composition was prepared having the following composition by weight:

Zircon: 77.5%

Saturated aliphatic hydrocarbons (Flash Point 42° C.): 9.0%

2-ethoxy ethanol: 7.5%

Quaternary alkyl ammonium montmorillonite gel: 5.0%

Southern Pinewood resin: 1.0%

The quaternary alkyl ammonium montmorillonite gel was prepared by dispersing 16 parts by weight of quaternary alkyl ammonium montmorillonite in 80 parts by weight of a mixture of saturated aliphatic hydrocarbons having a flash point of 42° C. and 4 parts by weight of methanol.

The coating composition was brushed on to foundry sand cores and ignited. The carrier liquid burned readily without the violence and high flame normally associated with isopropanol-containing coatings. There was no soot formation nor any unpleasant odour. The resulting coating on the cores was hard and well-bonded.

I claim:

1. A method of forming a coating on the surface of a foundry mould or core which method comprises applying to the surface a coating of a coating composition which comprises:

(i) an essentially aliphatic hydrocarbon having a flash point (Pensky-martens closed cup) in excess of 32° C., and (ii) one or more mono alkyl ethers of a polyhydric alcohol, and a particulate refractory material, and igniting the coating to burn off the carrier liquid.

2. A method according to claim 1 wherein component (i) is a petroleum distillate of low aromatic content.

3. A method according to claim 1 wherein the coating composition comprises from 30 to 70% by weight of (i) and from 70 to 30% by weight of (ii).

4. A method according to claim 1 wherein component (ii) is selected from the group consisting of ethylene glycol monoethyl ether,
diethylene glycol monoethyl ether,
triethylene glycol monoethyl ether,
ethylene glycol monomethyl ether and
ethylene glycol monobutyl ether.

5. A method according to claim 1 wherein the coating composition comprises 14.5 to 74.5% by weight of carrier liquid, 25 to 85% by weight of particulate refractory material and 0.5 to 10% by weight binder and suspension agent.

6. A method according to claim 1 wherein the particulate refractory material is selected from the group consisting of zircon, alumina, chromite, silica, talc, olivine and graphite and mixtures of two or more of these.

7. A method according to claim 1 wherein the coating composition includes a binding agent.

8. A method according to claim 1 wherein the coating composition includes a binding agent selected from the group consisting of colophony resin, Southern Pinewood resin, alkyd resins and phenol-formaldehyde resins.

9. A method according to claim 1 wherein the coating composition comprises a suspension agent.

10. A method according to claim 1 wherein the coating composition includes a suspension agent selected from the group consisting of hydrogenated castor oils and quaternary alkyl ammonium montmorillonite gels.

* * * * *